US005693923A

United States Patent [19]

Gula et al.

[11] Patent Number: 5,693,923

[45] Date of Patent: Dec. 2, 1997

[54] MOTOR OPERATOR FOR ELECTRICAL SWITCHES

[75] Inventors: Lance Gula, Independence Township; Roger W. Helms, Beaver Falls; David C. Turner, North Fayette; Kenneth Nordly Skoug, III, Pittsburgh, all of Pa.

[73] Assignee: Eaton Corporation, Cleveland, Ohio

[21] Appl. No.: 778,130

[22] Filed: Jan. 2, 1997

Related U.S. Application Data

[63] Continuation of Ser. No. 632,703, Apr. 15, 1996, abandoned.

[51] Int. Cl.[6] ..... H01H 1/00

[52] U.S. Cl. ..... 200/50.26

[58] Field of Search ..... 200/83 Q, 83 R, 200/50.26, 251, 61.62; 335/78–83, 128, 133, 270, 273–276; 180/289

[56] References Cited

U.S. PATENT DOCUMENTS 4,132,009 1/1979 Bochan ..... 200/61.62

4,253,319 3/1981 Feichtiger et al. ..... 200/83 Q 4,926,150 5/1990 Buchschmid et al. ..... 335/196

*Primary Examiner*—Aditya Krishnan

*Attorney, Agent, or Firm*—Martin J. Moran

[57] ABSTRACT

A motor operator unit for an electrical switch is pivotally mounted on a bracket to swing between a closed, operative position in which an actuator in the motor operator unit engages the switch handle for electrical operation of the switch handle and an open position in which the switch handle is freely accessible for direct manual operation. The compliant actuator which is translated by a motor driven threaded shaft overtravels at each end of its reciprocal path after actuation of the switch handle to toggle a single power switch which determines both direction and shutoff of motor operation. A lockout plate mechanically prevents electrical and manual operation of the switch handle and carries an interlock switch which only enables motor operation when the motor operator unit is in the operative position and not locked out. The actuator is configured to prevent full rotation of the motor operator to the operative position, if the position of the actuator, which is virtually identified by indicators, does not correspond to handle position.

14 Claims, 5 Drawing Sheets

FIG. 7
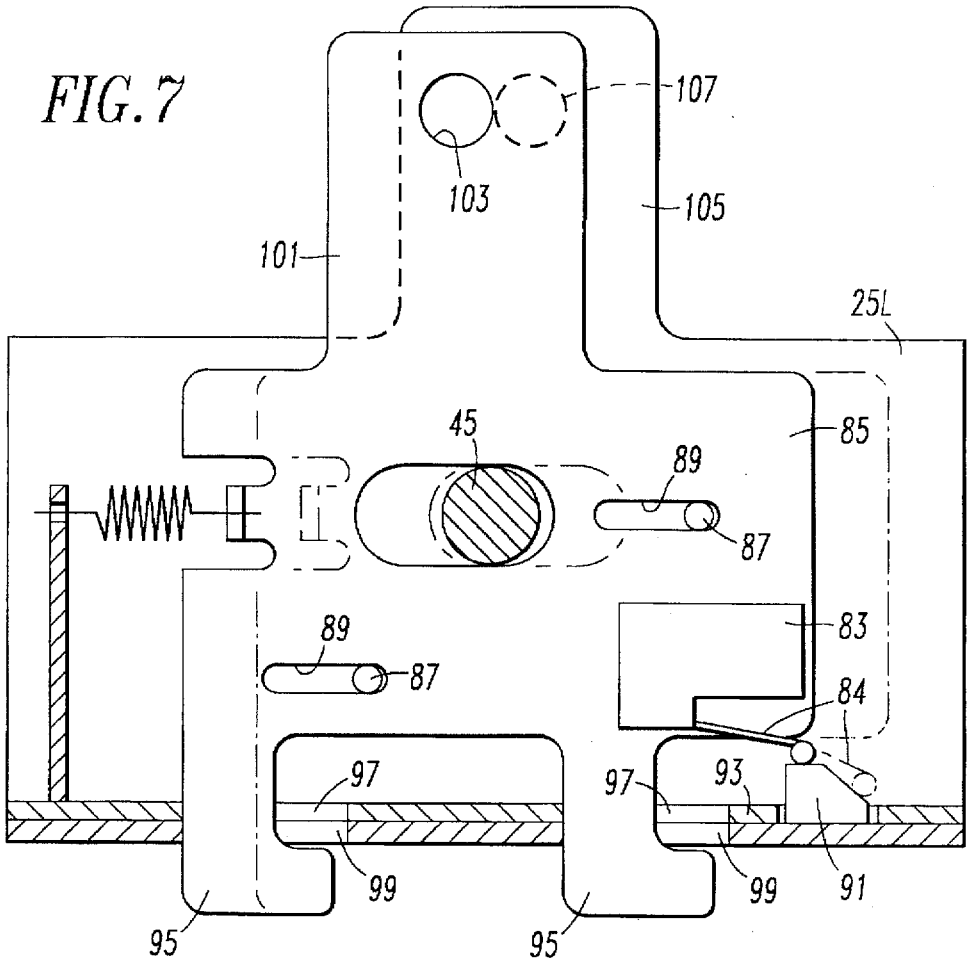
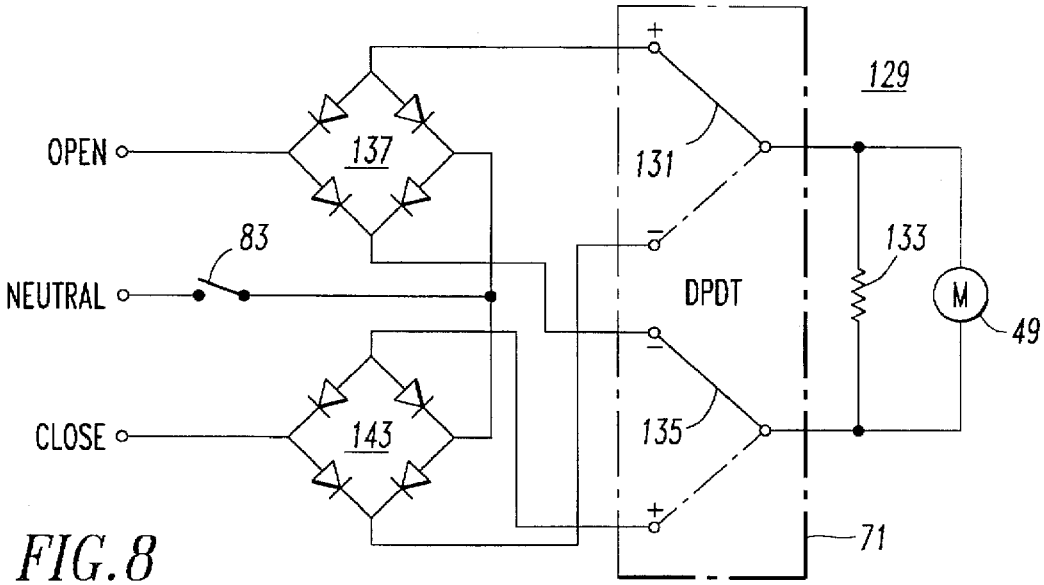
FIG. 8

MOTOR OPERATOR FOR ELECTRICAL SWITCHES

This application is a continuation of application Ser. No. 08/632,703, filed Apr. 15, 1996, now abandoned.

BACKGROUND OF THE INVENTION

1. Field of the Invention

This invention relates to motor driven apparatus for operating the handle of electrical switches, especially circuit breakers and contactors. More particularly, it relates to a motor operator that can be easily swung aside for manual operation of the switch handle, and which has a single power switch for energizing the motor and determining direction of handle travel.

2. Background Information

Motor operators for electrical operation of the handles of switches, particularly switches such as circuit breakers and contactors, are well known. Many such devices have an actuator forming a slot that engages the switch handle. Typically, the actuator is mounted on a threaded shaft rotated by an electric motor. It is common for the mounting of the motor operator to the switch to be such that once the motor operator is in place, the switch handle is not accessible for manual operation. In these installations, it is common for manual operation to be provided by a crank which rotates the threaded shaft in place of motor operation.

Also, in the currently available motor operators, separate switches such as limit switches are provided for de-energizing the motor at each end of travel of the actuator. These multiple microswitches also determine the direction of movement of the actuator, and therefore the switch handle.

There is a need for an improved motor operator for electrical switches.

Specifically, there is a need for a simpler, more reliable, more economical motor operator for electrical switches.

In this regard, there is a need for a more simplified control circuit for the motor operator which requires fewer switches.

There is also a need for a motor operator which easily provides direct access to the switch handle for manual operation.

SUMMARY OF THE INVENTION

These needs and others are satisfied by the invention which is directed to a motor operator assembly having a motor operator unit hinged at one end to a mounting bracket secured to the switch adjacent to the switch handle so that the motor operator unit may be readily rotated between an operative position in which it engages the switch handle for electrical operation of the switch, and a manual position in which the motor operator is rotated clear of the handle thereby providing direct access to the switch handle for manual operation. Latch means comprising a first latch member on the mounting bracket and second latch means mounted on a free end of the motor operator unit opposite the hinged end, releasably engage as the motor operator unit is rotated to the operative position. This makes the line of engagement and disengagement of the latching means transverse to movement of the actuator within the motor operator unit which engages the switch handle. Hence, the latching forces can be relatively light as the reaction to the movement of the switch handle does not tend to release the latch.

As another aspect of the invention, the motor operator unit includes an actuator which reciprocates the switch handle in the handle slot and toggles a single power switch to reverse direction of the electric motor driving the actuator after the switch handle has been driven to the ends of the handle slot. This single switch provides both direction control and shut-off for the motor following handle operation. The actuator has a compliant section forming a slot which engages the switch handle and allows the actuator to over-travel after the switch handle is operated to ensure switch operation before the power switch is toggled.

As yet another aspect of the invention, the motor operator unit includes an interlock switch which prevents energization of the motor until the unit is fully rotated to the operative position, and the actuator is configured to engage the handle to prevent rotation to the operative position and actuation of the interlock switch if the position of the actuator does not correspond to that of the switch handle. An interlock member selectively mechanically locks the motor operator unit in the operative position, but with the interlock switch opened to prevent both automatic and manual operation of the switch.

BRIEF DESCRIPTION OF THE DRAWINGS

A full understanding of the invention can be gained from the following description of the preferred embodiments when read in conjunction with the accompanying drawings in which:

FIG. 7 is a vertical sectional view through the motor operator taken along the line 7—7 in FIG. 3 and showing a lockout assembly which forms part of the motor operator unit and its interaction with a cam on the mounting bracket.

FIG. 8 is a schematic circuit diagram of the control circuit for the motor operator.

DESCRIPTION OF THE PREFERRED EMBODIMENT

Figure 1:
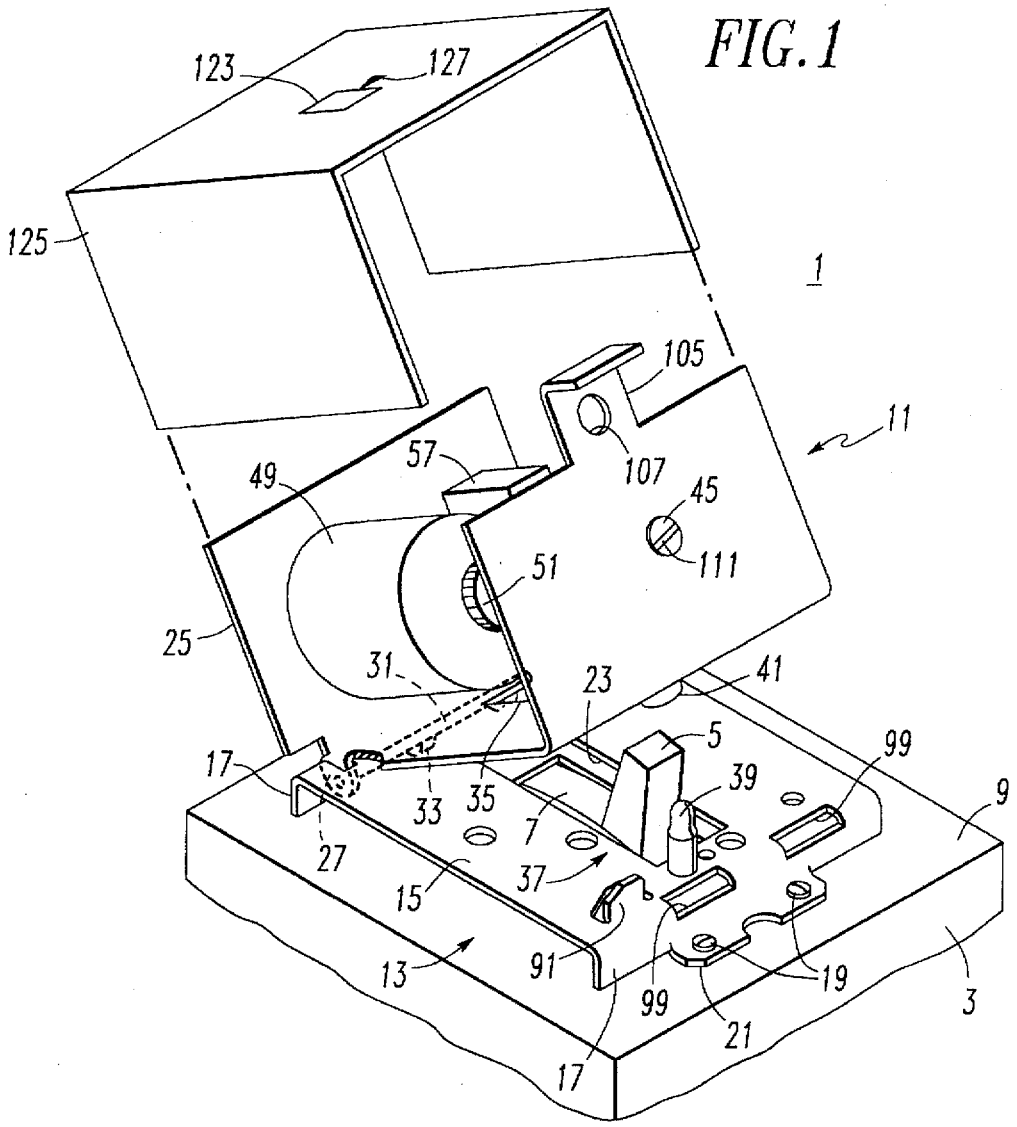
FIG. 1 is an exploded isometric view illustrating the motor operator assembly of the invention installed on a switch and partially opened to a manual position allowing direct access to the switch handle.

Referring to FIG. 1, the invention is directed to a motor operator assembly 1 used to operate a switch 3 such as the circuit breaker shown having a switch handle 5 which reciprocates in an elongated handle slot 7 in a face 9 of the switch. While the illustrative switch 3 is a circuit breaker, it will be appreciated that the motor operator 1 is suitable for use with other types of electrical switches including contactors and motor starters.

The motor operator assembly 1 includes a motor operator unit 11 and a mounting bracket 13 for securing the motor operator unit 11 to the switch 3 for operation of the switch handle 5. The mounting bracket 13 is a planar member 15 having opposite edges turned down to form legs 17. The bracket 13 is secured to the face 9 of the circuit breaker by fasteners 19 extending through mounting flanges 21 projecting laterally from the legs 17. The mounting bracket 13 is secured to the electrical switch 3 with a slot 23 in the planner member 15 aligned with the handle slot 7 and with the switch handle 5 projecting through the slot 23.

The motor operator unit 11 includes a U-shaped carriage 25 fabricated from sheet material with hinge members 27 punched out of one end 29. These hinge members 27 engage a pivot pin 31 retained by punched out section 33 in one end of the mounting bracket 13 so that the motor operator unit 11 is pivotally connected to the mounting bracket 13. The base of the carriage 25 has an elongated slot 35 which registers with the slot 23 in the mounting bracket 13 when the carriage 25 is rotated to an operative or closed position in which the carriage rests flat on the mounting bracket 13.

The motor operator unit is maintained in the operative or closed position by a latching mechanism 37, preferably a ball-snap latch, including a first, male latch member 39 mounted on the mounting bracket 13 and a second, female latch member 41 mounted on the carriage at a free end 43. This latch mechanism 37 allows the motor operator unit 11 to be easily secured in the operative position upon closing, and can be easily pulled open to allow manual access to the switch. It will be seen that the reaction forces within the motor operator unit 11 to movement of the switch are transverse to the relative movement of the latch members 39 and 41, so that operation of the motor operator unit does not tend to open the latch mechanism.

Figure 3:
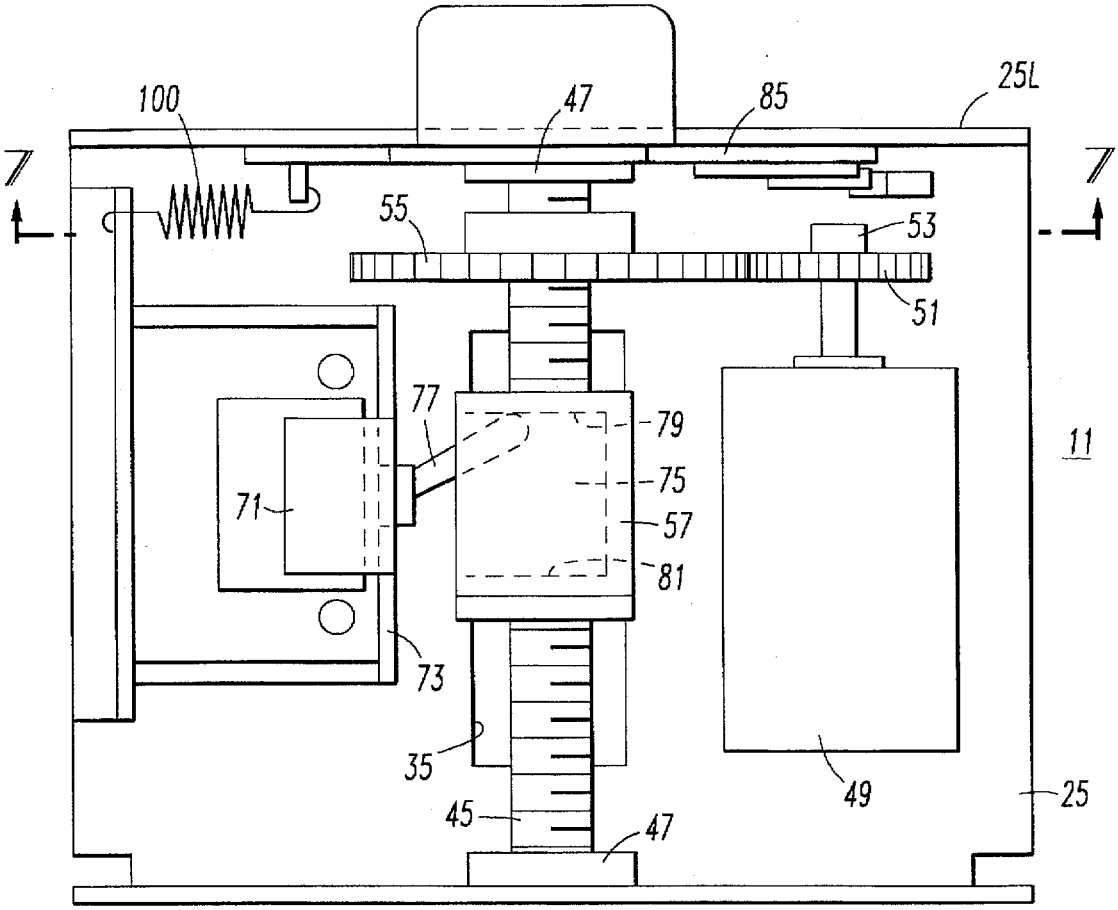
FIG. 3 is a top plan view of the motor operator in the operative position with the top cover removed.

Turning to FIG. 3, the motor operator unit 11 includes, in addition to the carriage 25, a threaded shaft 45 journaled in bearings 47 in the legs of the carriage 25. The threaded shaft 45 is rotated by an electric motor 49, mounted on the carriage 25, through a pair of gears 51 on the motor shaft 53 and gears 55 on the threaded shaft. The threaded shaft 45 is mounted above and parallel to the slot 35 in the carriage 25, and therefore, to the handle slot 7 in the switch 3.

Figure 4:
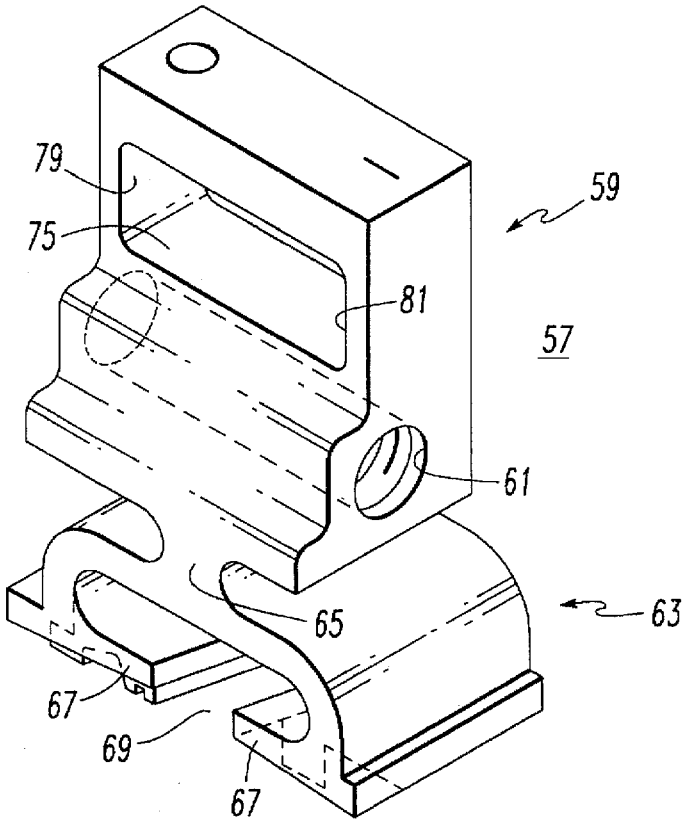
FIG. 4 is an isometric view of an actuator which forms part of the motor operator of the invention.
Figure 5:
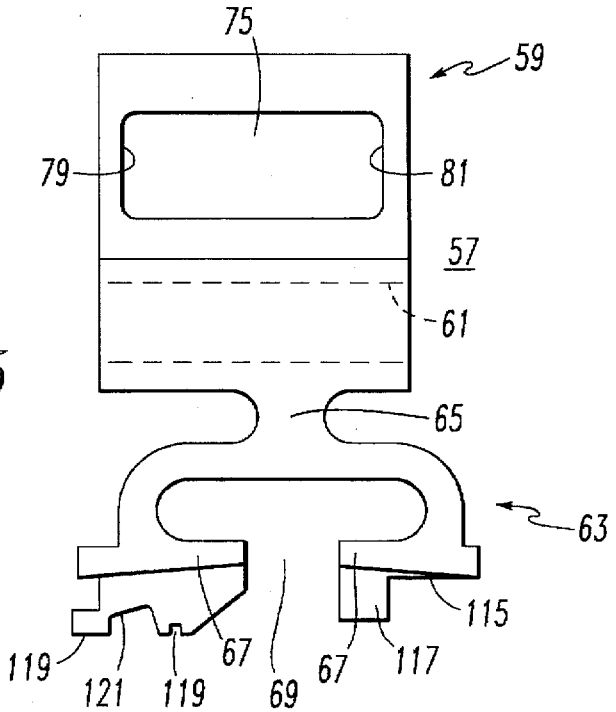
FIG. 5 is a side elevation view of the actuator of FIG. 4.

An actuator 57, as best seen in FIGS. 4 and 5, has a body section 59 having a threaded bore 61 which engages the threaded shaft 45. The actuator 57 has a compliant section 63 cantilevered from the body 59 by extension or support 65. The compliant section 63 has a pair of confronting fingers 67 which form between them a slot 69.

With the actuator 57 threaded on the shaft 45 by the bore 61, operation of the motor 49 reciprocates the actuator along the shaft 45. The fingers 67 are positioned adjacent the slot 35 so that the switch handle 5 is received in the slot 69 between the fingers. Thus, the switch handle 5 can be electrically operated by the motor operator unit 11.

The actuator 57 not only operates the switch handle 5, but also serves as the actuator for a single power switch 71, (see FIGS. 3 and 8). This power switch 71 is mounted on a bracket 73 secured to the carriage 25. The main body 59 of the actuator 57 has an elongated recess 75 in which the operating lever 77 of the power switch 71 is received. The recess 75 is sized and has end walls 79 and 81 spaced apart such that the switch 71 is toggled as the actuator reaches the ends of its reciprocal travel. As will be seen, the single power switch 71 determines the direction of movement of the actuator 57 and also terminates motor power at the end of each stroke. In order to ensure that the switch handle 5 is positively operated before terminating motor operation, the actuator 57 must overtravel at each end of its reciprocal path before toggling the single power switch 71. This is made possible by the compliant section 63 of the actuator which engages the switch handle 5. When the switch handle 5 reaches the end of its travel in the handle slot 7, the cantilevered support 65 bends, and the fingers 67 deform to allow the actuator to continue its travel until the power switch 71 is toggled.

The motor operator 11 further includes an electrical interlock switch 83 which controls operation of the motor 49 (see FIGS. 7 and 8). The interlock switch 83 is mounted on a locking plate 85 which is slidably mounted to the inside of the front leg 25L of the carriage 25 by guide pins 87 mounted on the leg 25L which engage slots 89 in the locking plate. With the motor operator unit 11 in the operative position so that the actuator 57 engages the switch handle 5, the interlock switch 83 is closed by a cam 91 punched out of the planner member 15 of the bracket (see FIG. 1) and extending through an opening 93 punched in the base of the carriage 25. This cam 91 engages the operating lever 84 of the switch 83. As will be seen, closing of the interlock switch 83 enables energization of the motor 49.

The locking plate 85 also performs a mechanical lockout function preventing operation of the electrical switch 3. To this end, the locking plate 85 has a pair of depending hooks 95 which project through openings 97 in the carriage 25. As the motor operator unit 11 is rotated to the operative position, the hooks 95 project through openings 99 in the front of the planner member 15 of the mounting bracket 13. In this position the interlock switch 83 is actuated by the cam 91 so that the switch handle 5 can be electrically operated by the motor operator unit. The locking plate 85 is biased to this unlocked position by a spring 100.

Figure 2:
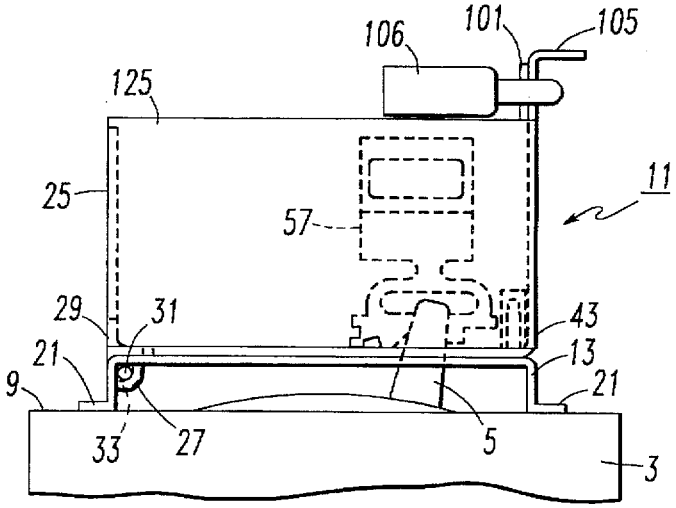
FIG. 2 is a side elevation view of the motor operator of FIG. 1 shown in the closed or operative position.

To lock-out operation of the switch 3, the locking plate 85 is pushed laterally so that the hooks 95 engage the bottom of the planner member 15 of the mounting bracket 13. This also moves the interlock switch 83 laterally so that it is no longer actuated by the cam 91. Thus, the switch handle 5 cannot be electrically operated by the motor operator unit 11. The locking plate has an extension 101 at its upper end with an aperture 103. With the locking plate 85 in the lockout position, the extension 101 on the locking plate is aligned with a hand grip extension 105 on the free end 43 of the carriage 25 so that the aperture 103 is in register with an aperture 107 in the hand grip 105 (see FIG. 1). A padlock 106 (see FIG. 2) can be inserted through the apertures 103 and 107 to mechanically lock the locking plate 85 in the lockout position. With the locking plate padlocked in the lockout position, the switch handle cannot be electrically operated since the interlock switch 83 is not closed, and it cannot be operated manually because the motor operator unit cannot be rotated out of the operative position to allow access to the handle 5.

Figure 6:
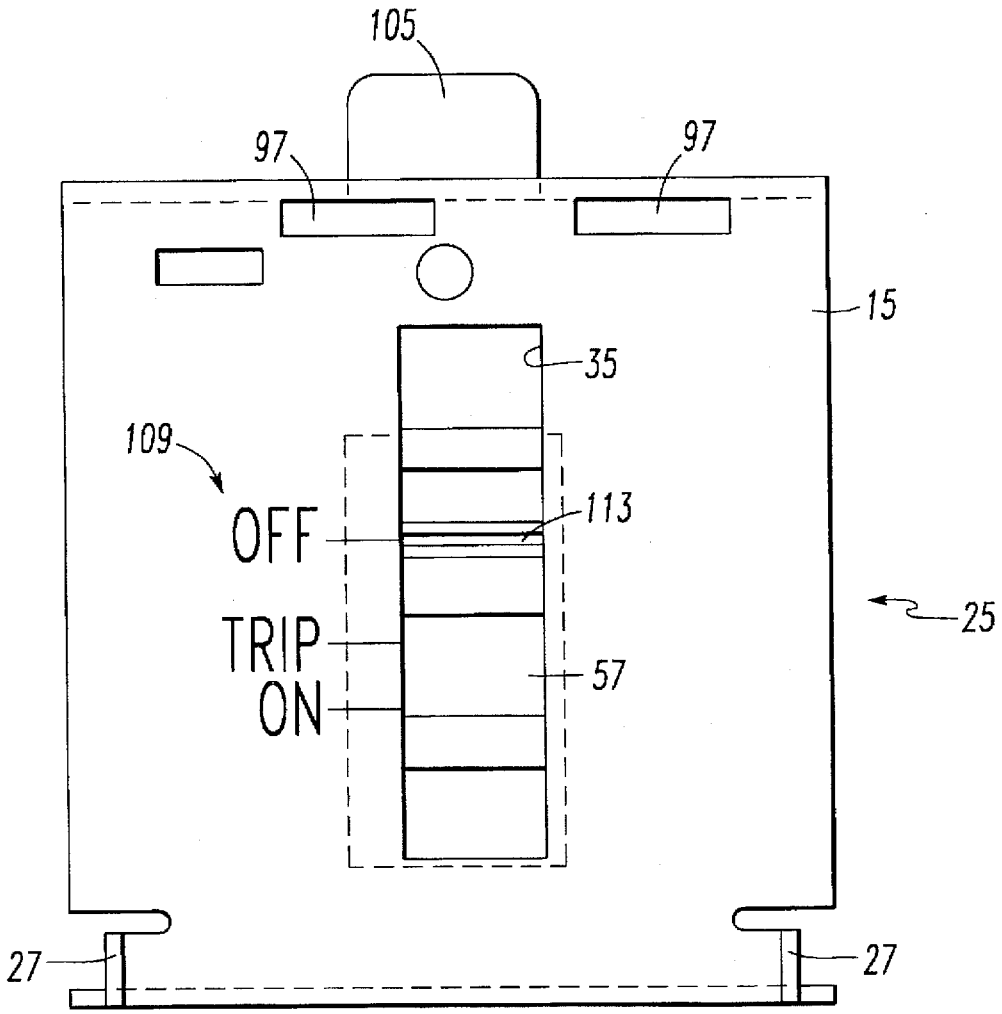
FIG. 6 is a bottom plan view of the motor operator unit.

One of the advantages of the invention is that the motor operator unit 11 can be easily swung to the open position providing access for manual operation of the switch handle 5 at any time that the motor operator unit is not padlocked in the lockout position. When rotating the motor operator unit 11 back to the operative position, it is important that the actuator 57 be positioned to properly engage the switch handle 5, which of course may be in a different position through manual operation than what it was when the motor operator unit was disengaged. The switch handle 5 can be at either end of the handle slot 7. If the switch 3 is a certain type of circuit breaker, the switch handle 5 can also be at an intermediate position indicating that the circuit breaker is tripped. In order to provide for proper alignment of the actuator before the motor operator unit 11 is moved to the operative position, a legend 109 is provided on the bottom of the carriage 25 adjacent the slot 35. This legend includes, as shown in FIG. 6, scribe lines with the wording OFF, TRIP, and ON. The actuator 57 is positioned by using a screwdriver inserted in a slot 111 in the end of the threaded shaft 45 and rotating it until a scribe line 113 on the bottom of the actuator is aligned with the proper inscription on the carriage corresponding to the physical position of the switch handle 5.

In order to ensure that the actuator 57 is properly aligned for the position of the switch handle 5, projections are provided on the bottom of the fingers 67 as shown in FIG. 5, which prevent full rotation of the motor operator unit 11 to the operative position if the motor operator is not in a position corresponding to that of the switch handle. This prevents actuation of the interlock switch 83 so that the motor 49 cannot be energized. If the actuator 57 is properly aligned, the switch handle 5 will enter the slot 69 allowing full closure of the motor operator unit and therefore closing of the interlock switch 83. However, if the actuator is located at the ON position but the circuit breaker is OFF, the handle 5 will strike the surface 115. If the operator is ON but the circuit breaker is in the TRIP position, it will strike the projection 117. On the other hand, if the actuator is in the OFF position, but the switch handle is in the ON position, it will strike the projection 119. When the actuator is in the OFF position but the circuit breaker is in the TRIP position, the end of the handle engages a recess 121. This recess 121 positively engages the handle and prevents it from being forced to the ON position while the actuator is in the OFF position.

As another aspect of the motor operator assembly 1 of the invention, a window 123 in the top of the cover 123 of the motor operator unit 11 (see FIG. 1) provides a visual indication of the position of the actuator 57, and therefore the position of the switch handle when the motor operator unit 11 is in the operative position. The position of the switch handle 5 is represented by the international symbol "/" for on and "O" for off appearing in the window 123 in alignment with a scribe line 127 on the cover.

FIG. 8 illustrates a schematic circuit diagram of the circuit 129 for energizing the motor 49 using the single power switch 71. This switch 71 is a double pole, double throw switch having one pole 131 connected to one side of the motor and a parallel resistor 133, and the other pole 135 connected to the other side of the motor and resistor. With the switch 71 in the position shown in solid line in FIG. 8, an OPEN supply lead 137 is connected to the motor 49 through an full wave rectifier bridge 139. The neutral lead 141 is connected through the interlock switch 83 so that the motor operator unit 11 must be in the operative position and the lockout plate 85 must not be in the lockout position so that the interlock switch 83 is closed. With power supplied to the OPEN lead 137, the motor 49 is energized to drive the actuator 57 to move the handle to the open position. As described above, the actuator overtravels to toggle the switch 71 to the position shown by the phantom line in FIG. 8. As the CLOSE lead 143 is not energized at this point, the motor 49 stops. When it is desired to close the switch, power is applied to the CLOSE lead 143 to energize the motor 49 through the full wave rectifier bridge 145. Again, the single power switch 71 will be toggled to turn off the motor 49 after the switch handle 5 has been moved to the closed position and will also set-up the motor for driving the switch handle in the opposite direction when the OPEN lead is energized. The circuit 129 shown is for an AC motor 49. Alternatively, the motor 49 can be DC, in which case the bridges 139 and 145 are not needed and the negative terminals for both poles can be connected directly to the lockout switch 83.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. A motor operator assembly for an electrical switch having a switch handle which projects from and reciprocates along a handle slot in a face of the switch, said assembly comprising:

a mounting bracket secured to said face of said switch adjacent to said handle slot;

a motor operator unit hinged at one end to said mounting bracket adjacent to said handle slot and rotatable about said one end between an operative position in which said motor operator unit engages said switch handle for reciprocating said switch handle in the handle slot, and a manual position in which said motor operator unit is rotated clear of said handle providing access for manual operation of said switch handle.

2. The motor operator assembly of claim 1 including latch means comprising a first latch member mounted on said mounting bracket and a second latch member mounted on said motor operator unit remote from said one end, said first and second latch members releasably engaging as said motor operator unit is rotated to said operative position.

3. The motor operator assembly of claim 1 wherein said motor operator unit comprises a threaded shaft, an electrical motor rotating said threaded shaft, an interlock switch through which said electrical motor can be energized only when said interlock switch is actuated with said motor operator unit in said operative position, and an actuator mounted on said threaded shaft and having a slot in which said switch handle is received for reciprocation along said handle slot through energization of said electric motor, said actuator engaging said handle to prevent rotation of said motor operator unit to said operative position and thereby prevent actuation of said interlock switch when said actuator is not in position on said threaded shaft corresponding to switch handle position and said switch handle is therefor not received in said slot in said actuator.

4. The motor operator assembly of claim 3 further including lockout means for selectively locking said motor operator unit in said operative position and preventing energization of said electric motor to thereby prevent movement of said switch handle.

5. The motor operator assembly of claim 4 wherein said lockout means comprising a lockout member mechanically securing the motor operator unit to said bracket to prevent rotation of said motor operator unit about said one end and for opening said interlock switch to prevent energization of said electric motor.

6. The motor operator assembly of claim 5 including a power circuit comprising an open power lead for energizing said electric motor to open said electrical switch, a close power lead energized to operate said motor to close said, and a single power switch toggled by said actuator to connect said open power lead to said motor after said switch handle has been operated by the actuator to a closed position and toggled by said actuator to connect said close power lead to said motor after said switch handle is moved to an open position, whereby said single power switch deenergizes said electric motor after said switch handle reaches said open and close position and determines direction of actuator movement.

7. The motor operator assembly of claim 6 wherein said actuator has a compliant section containing said slot in which said switch handle is received, said compliant section deforming once said switch handle reaches an end of said handle slot allowing said actuator to overtravel to toggle said single power switch.

8. The motor operator assembly of claim 3 wherein said motor operator unit includes a carriage on which said shaft, said electric motor and said actuator are mounted, said carriage having a carriage slot along which said actuator is driven along said threaded shaft, said carriage further having indicator means adjacent to the carriage slot indicating position of said actuator in terms of off, on, and trip positions of said switch handle.

9. A motor operator unit for an electric switch having a switch handle which projects from and reciprocates in a handle slot in a face of said switch, said motor operator unit comprising:

a carriage mounted to said electric switch adjacent to said handle slot, a threaded shaft mounted in said carriage generally parallel to said handle slot, an actuator mounted on said threaded shaft and engaging said switch handle, motor means rotating said threaded shaft to drive said actuator along said threaded shaft and thereby move said handle between ends of said handle slot, and a power circuit comprising a single power switch toggled by said actuator to reverse direction of said electric motor after said switch handle has been driven to each of said ends of said handle slot.

10. The motor operator unit of claim 9 wherein said actuator has a compliant section engaging said switch handle which allows said actuator to overtravel when said switch handle reaches an end of said handle slot in order to toggle said single power switch.

11. The motor operator unit of claim 10 wherein said actuator comprises a main body having a threaded bore engaging said threaded shaft and a recess having ends which engage said single power switch, said compliant section comprising confronting fingers forming a slot there between in which said switch handle is received.

12. The motor operator unit of claim 11 in which said compliant section of said actuator further comprises a compliant support member cantilevered from said main body and having a free end to which said confronting fingers are attached.

13. A motor operator assembly for an electrical switch having a switch handle which projects therefrom, comprising:

a mounting bracket secured to said switch;

a motor operator unit attached to said mounting bracket and movable thereon between an operative position in which said motor operator unit engages said switch handle for moving said switch handle, and a manual position in which said motor operator unit is clear of said handle providing access for manual operation of said switch handle;

wherein said motor operator unit comprises an interlock switch through which said electrical motor can be energized only when said interlock switch is actuated with said motor operator unit in said operative position; and lockout means for selectively locking said motor operator unit in said operative position and preventing energization of said electric motor to thereby prevent movement of said switch handle, wherein said lockout means comprising a lockout member mechanically securing the motor operator unit to said bracket to prevent movement of said motor operator unit to a position which is clear of said handle to thus prevent manual operation of said switch handle and for opening said interlock switch to prevent energization of said electric motor.

14. A motor operator assembly for an electrical switch having a switch handle which projects therefrom, comprising:

a motor operator which engages in said switch handle for movement of said switch handle, said motor operator unit including an electrical motor and an actuator in which said switch handle is received for movement; and a power circuit comprising an open power lead for energizing said electric motor to open said electrical switch, a close power lead energized to operate said motor to close said electrical switch, and a single power switch toggled by said actuator to connect said open power lead to said motor after said switch handle has been operated by the actuator to a closed position and toggled by said actuator to connect said close power lead to said motor after said switch handle is moved to an open position, whereby said single power switch de-energizes said electric motor after said switch handle reaches said open and close position and determines direction of actuator movement.

* * * * *